US007437973B2

(12) United States Patent
Cellini

(10) Patent No.: US 7,437,973 B2
(45) Date of Patent: Oct. 21, 2008

(54) MOVEMENT-ASSISTED CORKSCREW

(75) Inventor: Mario Cellini, Maniago (IT)

(73) Assignee: Farmitaly S.R.L., Maniago (IT)

( * ) Notice: Subject to any disclaimer, the term of this patent is extended or adjusted under 35 U.S.C. 154(b) by 0 days.

(21) Appl. No.: 10/588,111

(22) PCT Filed: Nov. 23, 2004

(86) PCT No.: PCT/EP2004/053066

§ 371 (c)(1),
(2), (4) Date: Jul. 31, 2006

(87) PCT Pub. No.: WO2005/075337

PCT Pub. Date: Aug. 18, 2005

(65) Prior Publication Data

US 2007/0125200 A1 Jun. 7, 2007

(30) Foreign Application Priority Data

Jan. 29, 2004 (IT) ..... PN2004A0006

(51) Int. Cl.
*B67B 7/04* (2006.01)

(52) U.S. Cl. ..... 81/3.47; 81/3.36; 81/3.45

(58) Field of Classification Search ..... 81/3.47, 81/3.09, 3.36, 3.37, 3.29, 3.45, 3.55, 3.48
See application file for complete search history.

(56) References Cited

U.S. PATENT DOCUMENTS

| | | | | |
|---|---|---|---|---|
| 4,437,359 | A | 3/1984 | Dejoux et al. | |
| 4,584,911 | A * | 4/1986 | Cellini | 81/3.36 |
| 5,454,282 | A * | 10/1995 | Del Mistro | 81/3.48 |
| 5,887,305 | A | 3/1999 | Cellini | |
| 6,116,116 | A | 9/2000 | Brucart Puig et al. | |
| 6,176,154 | B1 * | 1/2001 | Brucart Puig et al. | 81/3.47 |
| 6,732,611 | B2 * | 5/2004 | Miguel | 81/3.29 |

FOREIGN PATENT DOCUMENTS

| | | |
|---|---|---|
| EP | 0 041 026 A1 | 12/1981 |
| EP | 0 748 761 A1 | 12/1996 |
| EP | 0 955 264 A1 | 11/1999 |

* cited by examiner

*Primary Examiner*—D. S Meislin
(74) *Attorney, Agent, or Firm*—Wenderoth, Lind & Ponack, L.L.P.

(57) ABSTRACT

A corkscrew includes a handgrip (1), a screw (2) associated to the handgrip (1) by means of a first pivoting connection (3), and an arm (4, 4') comprising first abutting members (5, 5') and associated to the handgrip (1) by means of a second connection (21) that enables the arm (4, 4') to rotate, with the arm (4, 4') being further capable of performing a second movement relative to the handgrip (1).

The inventive corkscrew is characterized in that it comprises elastic means (10) that are adapted to affect at least the second movement of the arm (4, 4') so as to assist in pulling out a cork (7) from a bottle (6).

16 Claims, 6 Drawing Sheets

MOVEMENT-ASSISTED CORKSCREW

FIELD OF THE INVENTION

The present invention refers to a corkscrew, in which at least one of the movements of an arm provided with abutting members interacting with the neck of the bottle is driven, i.e. assisted so as to facilitate pulling out the cork.

DESCRIPTION OF RELATED ART

Patent application EP 0 143 475 A1 discloses a corkscrew, in which the pivoting connection, which associates the handgrip with the arm intended for resting against the neck of a bottle, is movable, and the corkscrew itself is further provided with cam means co-operating with an abutment surface provided in the arm. A typical drawback found in a corkscrew of this kind lies in the fact that the displacement of the pivoting connection of the arm, which is brought about by the force applied by the user during the cork drawing operation, is hindered by the resisting action brought about by the friction intervening between the pivoting connection and the guide within which the connection is displaceable. The need of exerting a relatively intense force on the corkscrew causes, after a certain number of use cycles thereof, the contact surfaces of the cam means and the related abutment to wear down, thereby impairing the effectiveness of the corkscrew operation. As a result, a need is generally felt for reducing the effort required to complete the corkscrew operation for drawing a cork from the neck of a bottle.

Also known from the disclosure in the above-cited patent application EP 0 143 475 A1 are corkscrews, in which the pivoting connection of the arm with the handgrip is displaceable between two or more positions regardless of the rotation of the handgrip, thereby allowing the distance from the fulcrum of the lever and the pivoting connection of the screw to vary as a cork drawing operation is being performed.

A drawback typically found in the use of corkscrews of this kind lies in the fact that the operation to pull out the cork from the neck of the bottle proves particularly awkward and demanding to carry out, since the user is required to pay a lot of attention to the position into which he/she sets the lever fulcrum during the various phases of the cork drawing operation, considering that, once the lever fulcrum is forced out of a given position, the fulcrum itself is practically free to move without any control and, therefore, might well move into a second undesired position.

A corkscrew provided with a displaceable fulcrum, and enabling a cork to be pulled out in a two-step procedure, is described in EP 0 041 026 A1. A corkscrew of this kind, however, has a major drawback in that the user, upon completing the first step provided for by the cork drawing procedure, must re-position the resting arm on the bottle, wherein he/she must pay attention to the fulcrum of the lever, which must be situated in a position where the distance thereof from the pivoting connection of the screw is at a maximum. This operation, which of course takes place when the screw is still inserted in the cork, is made rather awkward by the position that must necessarily be taken by the handgrip of the corkscrew in order to repeat a part of its displacement and completing the pulling out of the cork. The handgrip must in fact be inclined just on the side that, by the effect of gravity, favours the fulcrum to become positioned in a region close to the position which is the nearest one to the pivoting connection of the screw. This circumstance is rather undesired, actually, since it practically induces the fulcrum to become positioned in a manner that is just the opposite of the one that should on the contrary be attained for a greater effectiveness in completing the second step of the cork drawing operation. It can moreover be readily appreciated that a correct re-positioning of the fulcrum according to the indications in EP 0 041 026 A1 would anyway prove particularly difficult if the aperture, within which the fulcrum is capable of moving, is not provided with appropriate positioning notches corresponding to the greatest and smallest distance of the same fulcrum from the pivoting connection of the screw.

SUMMARY OF THE INVENTION

It therefore is a main object of the present invention to provide a corkscrew that overcomes the typical drawbacks of prior-art corkscrews.

Within this general object, it is a purpose of the present invention to provide a corkscrew that is effective in enabling the effort required to pull a cork out of a bottle to be sensibly reduced.

Yet a further purpose of the present invention is to provide a corkscrew, in which the movement of the abutting arm is such as to enable the operations involved in pulling out a cork from a bottle to be simplified.

A final, although not less important purpose of the present invention is to provide a corkscrew, which is simple to manufacture and assemble.

BRIEF DESCRIPTION OF THE DRAWINGS

According to the present invention, these aims as set forth above are reached in a corkscrew incorporating the characteristics as described below by way of non-limiting examples with reference to the accompanying drawings, in which.

DETAILED DESCRIPTION OF PREFERRED EMBODIMENTS

Figure 1:
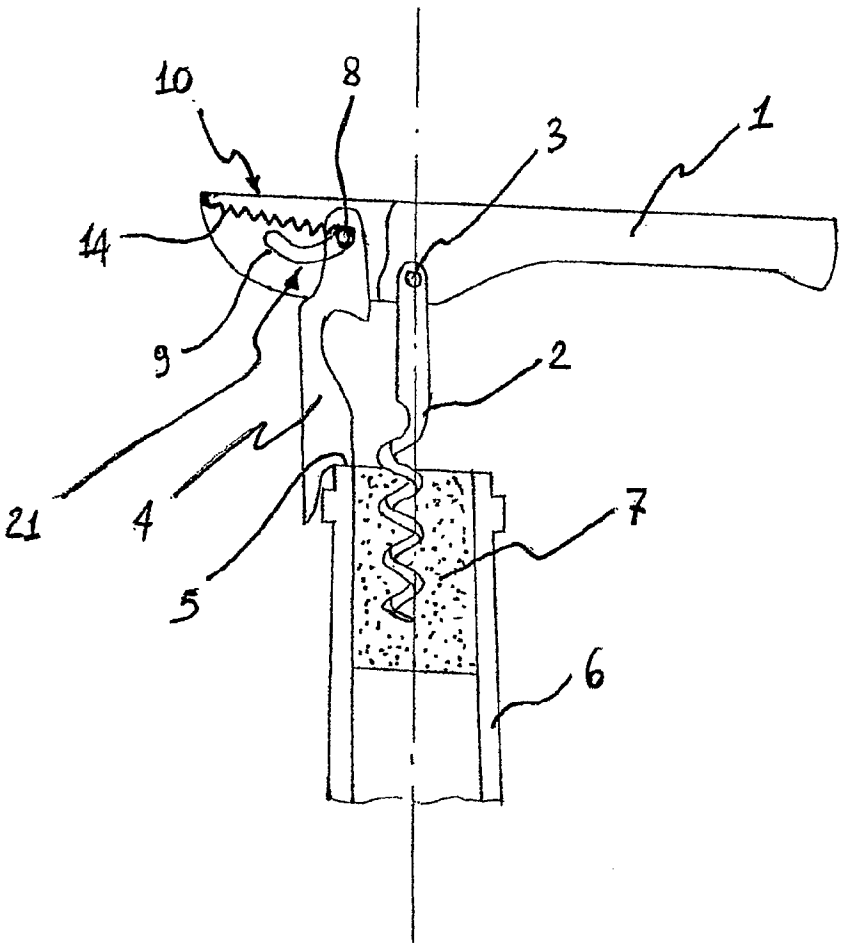
FIG. 1 is a partially cross-sectional view of a first embodiment of the corkscrew according to the present invention, as shown in a state in which it engages a cork in the neck of a bottle.

With reference to FIG. 1, a first embodiment of the corkscrew according to the present invention is shown. An end portion of the corkscrew illustrated in FIG. 1 has been intentionally represented as a cross-sectional view in order to highlight the articulation of the various moving parts. The corkscrew comprises a handgrip 1, on which a screw 2 is mounted by means of a first pivoting connection 3. The screw 2, of a kind known as such in the art, is adapted to perforate the material which a cork 7 used to stop a bottle 6 is made of. The corkscrew further comprises an arm 4 provided with first abutting members 5 engaging the neck of a bottle 6 during the cork drawing operation. The arm 4 is associated to the handgrip 1 by means of a second connection 21 which enables the arm 4 to rotate. This second connection 21 is preferably constituted by the coupling of a stud 8 with a slot 9, so that the arm 4 is able to perform a second movement, in particular a translatory movement. In the example shown in FIG. 1, the stud 8 is firmly joined to the arm 4, whereas the slot 9 is provided in the handgrip 1. It will of course be appreciated that a connection 21 may also be used, in which the stud 8 is firmly joined to with the handgrip 1, whereas the slot 9 is provided in the arm 4, as this shall be illustrated in greater detail further on. In the same way, other types of connections may be used, as well, such as for instance connections that would enable the arm 4 to perform two pivoting motions about different centres, while it will similarly be appreciated that particular forms of the connection 21 may be provided, which would enable the arm 4 to perform any number and kind whatsoever of motions to more suitably comply with any particular requirement or need.

The corkscrew 1 illustrated in FIG. 1 comprises elastic means 10 (an elastic member), which, as shall be explained in a more detailed manner further on in this description, are capable of affecting at least one of the movements performed by the arm 4 in view of assisting in the pulling out of the cork 7 from the bottle 6. In this first embodiment of the present invention, the elastic means 10 are constituted by a coil spring 14 and are situated between the arm 4 and the handgrip 1. In a preferred manner, these elastic means 10 are accommodated in a compartment within the handgrip 1 and connect the handgrip 1 to the stud 8 that is firmly joined to the arm 4.

In the position represented in FIG. 1, the corkscrew is ready to start pulling out, i.e. drawing the cork 7. The arm 4 is arranged so that the first abutting members 5 engage the neck of the bottle 6, and so that the stud 8 comes to lie close to the end portion of the slot 9 that is the nearest one to the pivoting connection 3 of the screw 2. Bringing in this way the arm 4 close to the first pivoting connection 3 entails an increase in the potential energy of the elastic means 10; during the operation performed to pull out the cork 7, such energy will be converted into a force acting on the arm 4, thereby affecting the translatory movement thereof. In the case that a coil or spiral spring 14 is used as the elastic means 10, such force will be a pulling force.

Figure 2:
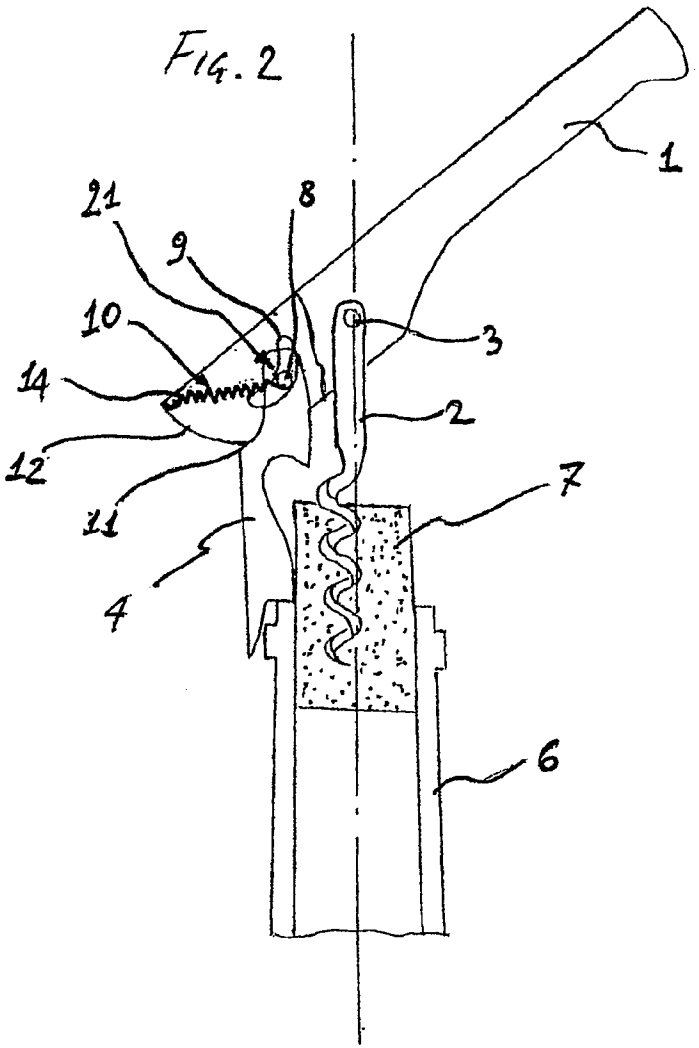
FIG. 2 is a partially cross-sectional view of the embodiment illustrated in FIG. 1, as shown during the drawing of a cork from a bottle.

In FIG. 2 the corkscrew is represented in a state as the cork 7 is being pulled out from the bottle 6. The action exerted by the user on the handgrip 1 causes the slot 9 to displace, while a surface 11 provided on the arm 4 moves into contact with cam means 12 provided on the handgrip 1. The angular displacement of the handgrip 1 is assisted by the action of the elastic means 10, which exert a force on the arm 4, thereby affecting the movement thereof in the sense of not only facilitating the cork 7 being pulled out, but also opposing the contrasting action exerted by the friction forces generated between the stud 8 and the slot 9. In this manner, the effort that the user must exert in order to displace the handgrip 1 angularly is positively reduced.

The elastic means 10 are adapted to favour a movement of the arm 4 in a first direction, as well as to oppose such movement in a second direction opposite to the first one. Advantageously, the first direction is the one in which the drawing operation for pulling out the cork 7 is favoured, i.e. the direction in which the arm 4 moves away from the first pivoting connection 3 of the screw 2 to the handgrip 1.

Figure 3:
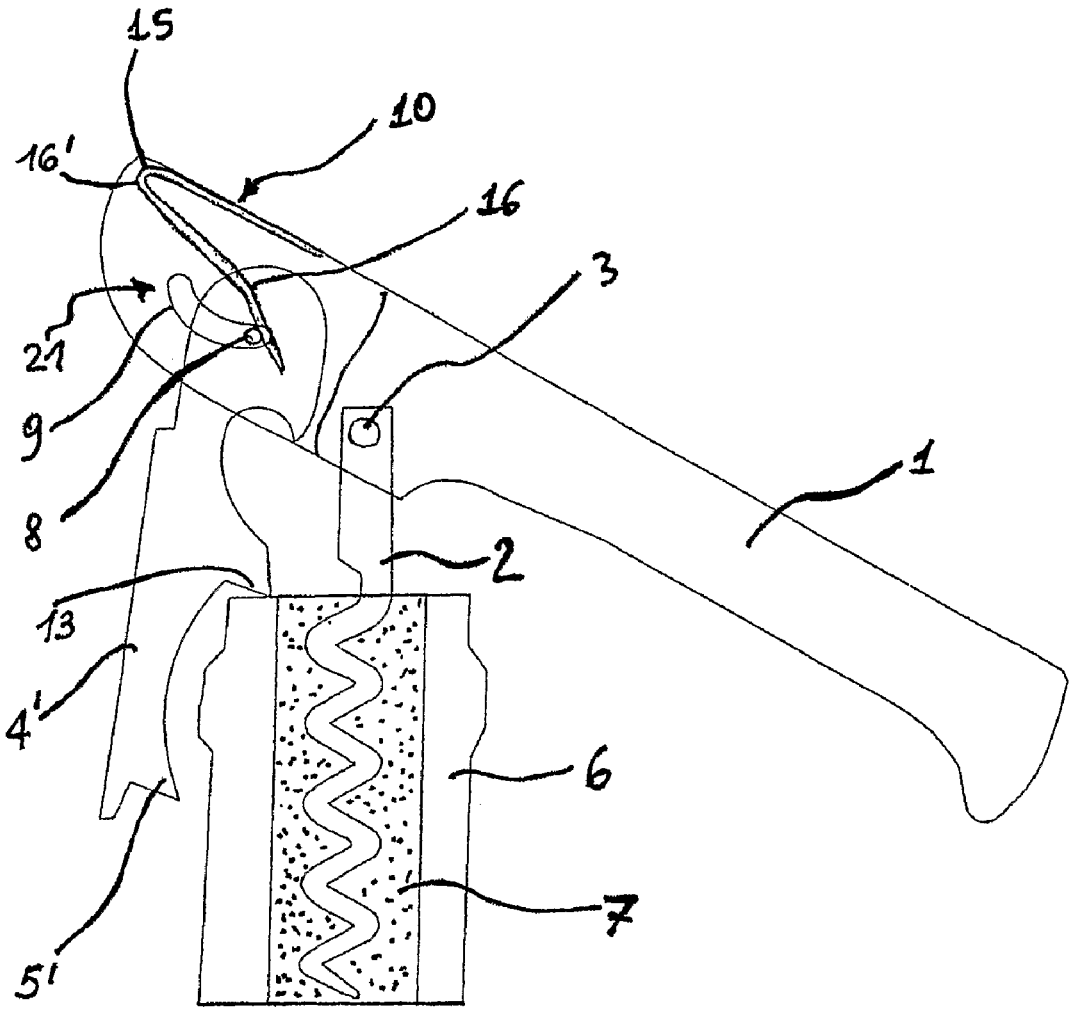
FIG. 3 is a partially cross-sectional view of a second embodiment of the corkscrew according to the present invention, as shown in a first drawing step of the cork from a bottle.

FIG. 3 illustrates a second embodiment of the corkscrew according to the present invention, in which—similarly to the illustrations appearing in FIGS. 1 and 2—an end portion of the corkscrew has been intentionally represented as a cross-sectional view in order to highlight the articulation of the moving parts. The corkscrew illustrated in FIG. 3 is of the type adapted to pull out a cork 7 in a two-step procedure. The handgrip 1, along with the screw 2, the first pivoting connection 3 and the second connection 21 constituted by the coupling of a stud 8 with a slot 9, are fully similar to the corresponding parts and details that have been described with reference to FIGS. 1 and 2. What actually differs from the previously illustrated embodiment is the conformation of the arm 4', which comprises second abutting members 13 situated between the first abutting members 5' and the type of elastic means 10 used in this case. In this second embodiment of the corkscrew according to the present invention, in fact, the elastic means 10 are constituted by a flat or leaf spring 15, which may advantageously be accommodated in an appropriate recess or compartment provided in the handgrip 1. This flat spring 15 has a portion of the surface thereof that is in contact with the handgrip 1, while another portion of the surface thereof is in contact with the stud 8 provided firmly joined to the arm 4'. It will of course be readily appreciated that, if the configuration of the second connection 21 is such that the slot is provided in the arm and the stud is on the contrary firmly joined to the handgrip, the elastic means 10 need to be arranged between the arm and the handgrip.

In FIG. 3, the corkscrew is represented in the configuration that enables the first cork drawing step to be started. The screw 2 is inserted in the cork 7 over most of the length thereof and the second abutting members 13 engage, i.e. bear against the neck of the bottle 6. The stud 8 is situated near the end portion of the slot 9, which is the nearest one to the pivoting connection 3 of the screw 2. The particular arrangement of the arm 4' illustrated in FIG. 3 has the practical effect of increasing the potential energy of the elastic means 10. By applying a force to the handgrip 1 so as to cause it to pivotally rotate, a first part of the drawing operation of the cork 7 is completed. As this has already been described in connection with the first embodiment, the elastic means 10 are effective in reducing the effort requested to move the handgrip 1, thereby assisting the pulling out of the cork 7. Moreover, once the first cork drawing step is completed, the user must re-position the arm 4' so as to bring the first abutting members 5' in contact with the neck of the bottle 6. This operation, which takes place while the screw 2 is still inserted in the cork 7, is facilitated by the release of the potential energy built up and stored in the elastic means 10 at the beginning of the first cork drawing step of the procedure. This energy is converted into a force that is effective in causing the arm 4' to displace towards the end of the slot 9, which is the farthest away from the first pivoting connection 3. The stud 8, which is firmly joined to the arm 4', is therefore moved into an optimum position in view of completing the cork drawing operation for pulling out the cork 7.

Figure 4:
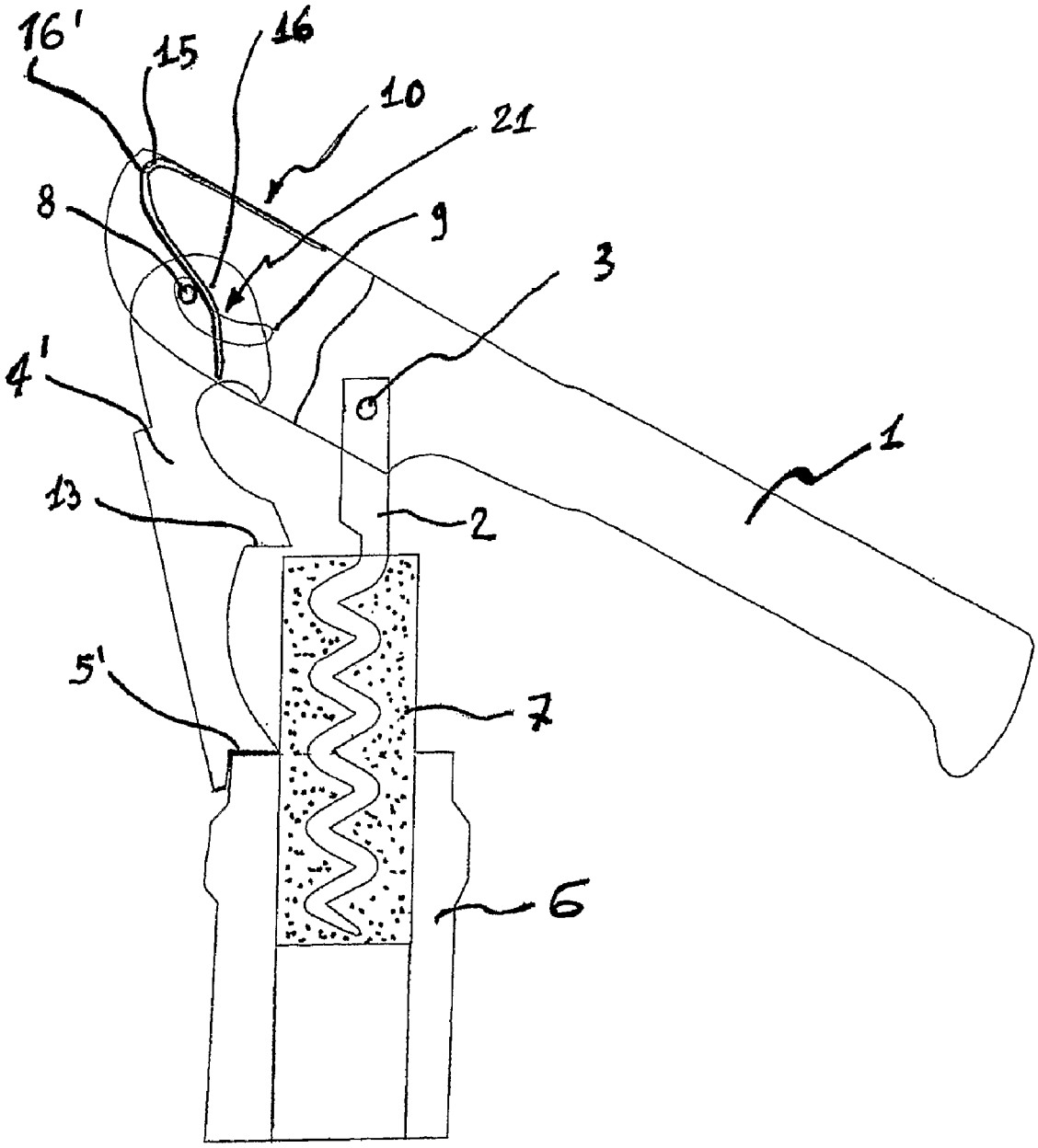
FIG. 4 is a partially cross-sectional view of the embodiment illustrated in FIG. 3, as shown in a second drawing step of the cork from a bottle.

In practice, for the user to change over from the configuration that the corkscrew comes to take at the end of the first cork drawing step to the configuration that is more suited to starting the second cork drawing step, as illustrated in FIG. 4, the user him/herself just needs to disengage the arm 4' through a slight angular displacement of the handgrip 1 in the opposite direction with respect to the one followed to perform the first cork drawing step. In this manner, the arm 4' will be practically driven to move into the position required to complete the cork drawing operation for pulling out the cork 7. In order to favour a variation in the speed of movement of the arm 4', the flat spring 15 comprises at least a surface portion 16 and 16' featuring a cusp-like conformation. This contrivance will in fact be effective in ensuring that, when brought into contact with the flat spring 15, the stud 8, or the arm 4' depending on how the connection 21 is actually implemented, will displace on a surface having a different sloping pattern, thereby changing its speed of displacement.

Figure 5:
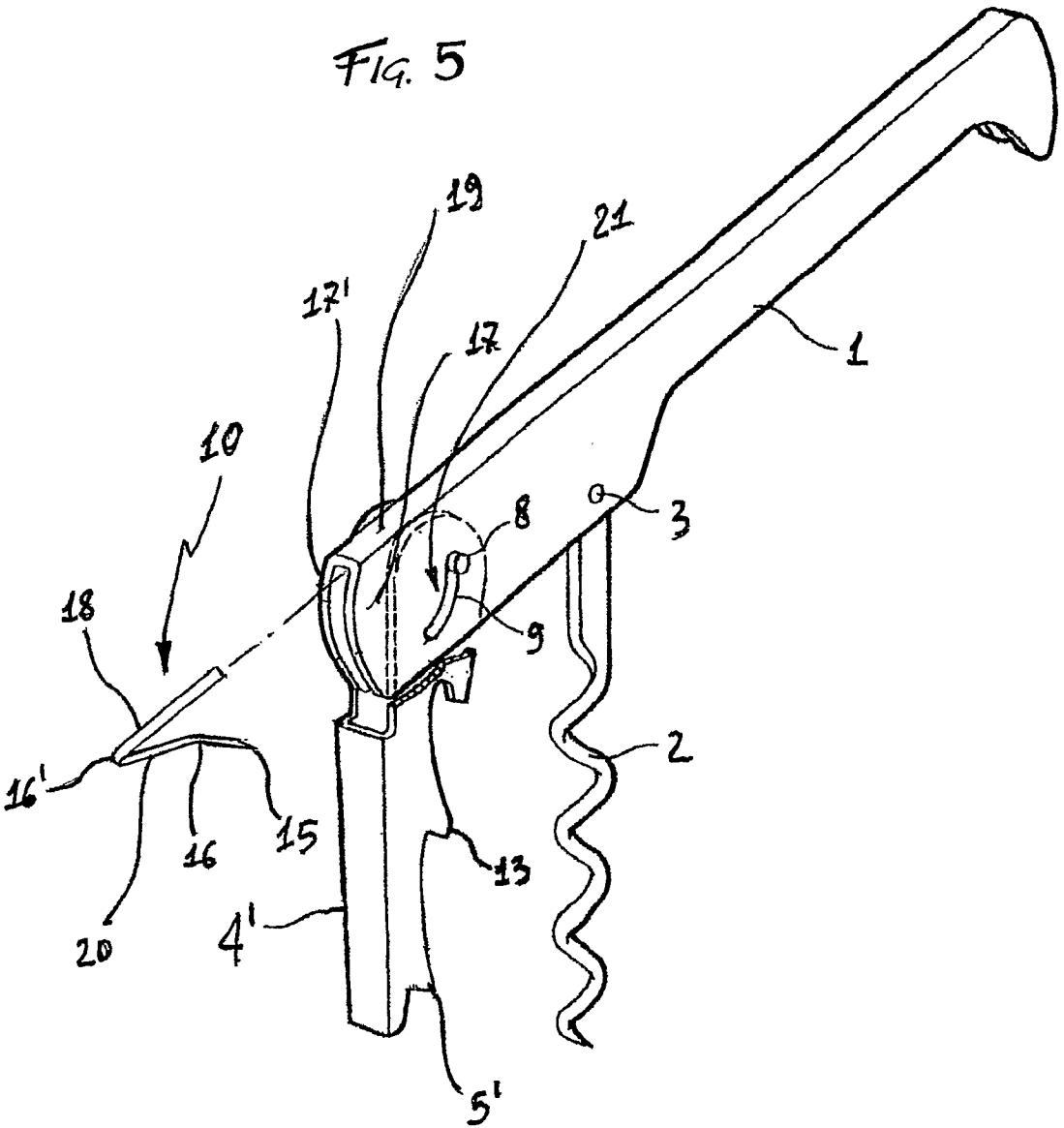
FIG. 5 is a partially cross-sectional view of the embodiment illustrated in FIG. 3, as shown in a state in which the elastic means have been disassembled.

FIG. 5 illustrates the second embodiment of the corkscrew according to the present invention, in which the elastic means 10, in the form of a flat spring 15, have been disassembled from the handgrip 1. These elastic means 10 are accommodated in a recess, or compartment, provided between two parallel walls 17 and 17', which define the end portion of the corkscrew to which there is associated the arm 4'. The flat spring 15 comprises a first surface portion 18 which, when the spring is assembled in the corkscrew, bears against the portion 19 connecting the two walls 17 and 17' of the handgrip 1 to each other. A second surface portion 20 of the flat spring 15 interacts with the stud 8 associated to the arm 4' so as to affect at least a displacing movement thereof.

The arrangement of the flat spring 15 within the handgrip 1 illustrated in FIG. 5 is based on a kind of connection 21 of the slot-and-stud type selected for this second embodiment of the corkscrew according to the present invention by way of a non-limiting example. It will of course be readily appreciated that other configurations may be used in accordance with the kind of connection 21 used, as well as the kind of movement of the arm that has to be affected, i.e. assisted, wherein all these configurations will fall within the scope of the present invention.

Figure 6:
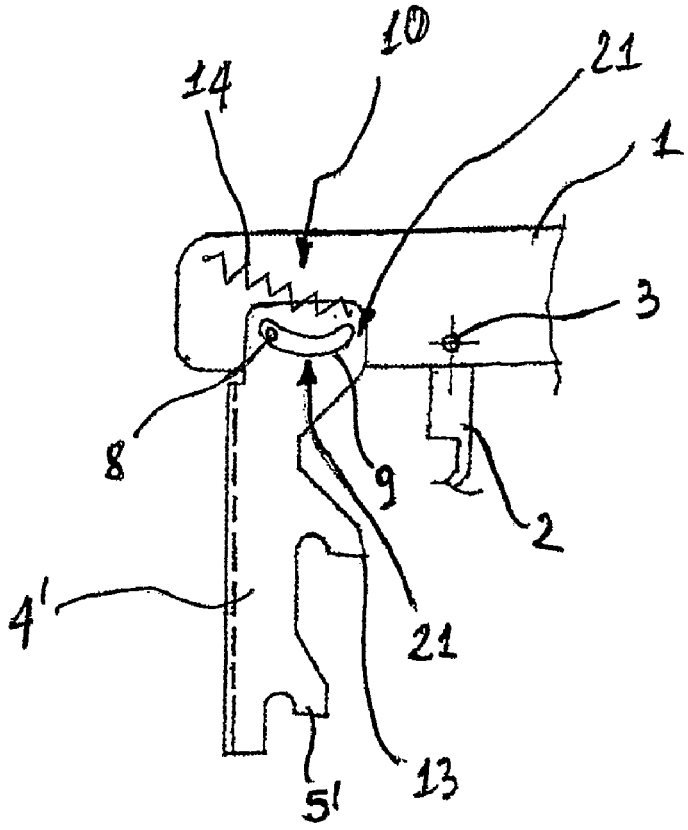
FIG. 6 is a view of a third embodiment of the corkscrew according to the present invention, in which the arm is arranged for a first drawing step of the cork from a bottle.
Figure 7:
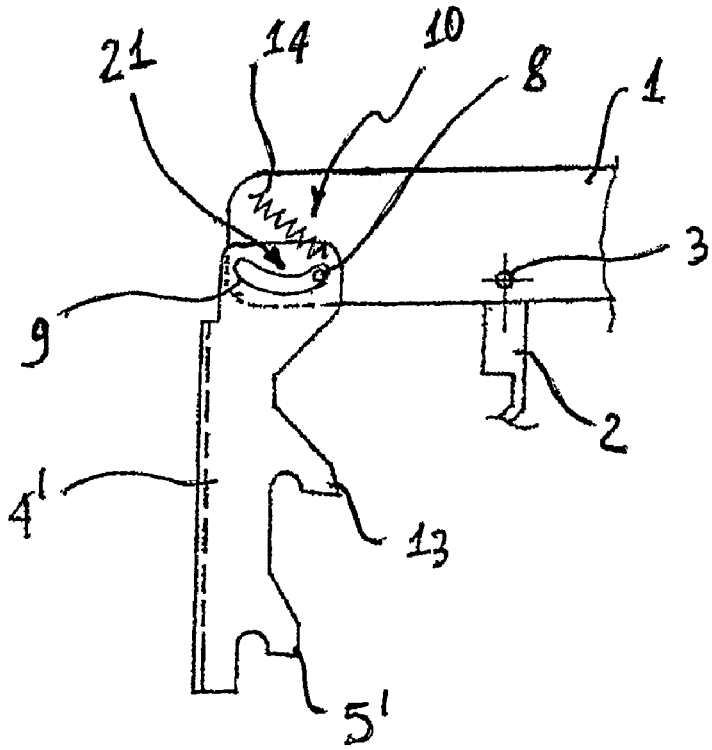
FIG. 7 is a view of the embodiment illustrated in FIG. 6, in which the arm is arranged for a second drawing step of the cork from a bottle.

FIGS. 6 and 7 illustrate a third embodiment of the corkscrew according to the present invention. By way of example, the arm 4' has in this case been conformed so as to allow for a cork to be pulled out in a two-step procedure, in much the same way as previously described in connection with the second embodiment of the corkscrew according to the present invention. It will of course be appreciated that use can be made here of even an arm 4 of the type illustrated in FIGS. 1 and 2. Anyway, in this third embodiment of the present invention, the connection 21 of the arm 4' to the handgrip 1 is constituted by a stud 8, which is firmly joined to the handgrip 1, and a slot 9 that is provided in the arm 4'.

FIG. 6 illustrates the arm 4' as arranged in the position that allows for the first cork drawing step to be performed, i.e. in the position that is the nearest one to the first connection 3 of the screw 2 to the handgrip 1. In this manner, the second abutting members 13 are able to engage the neck of a bottle when the screw 2 is inserted in the cork. Such arrangement of the arm 4' enables the potential energy of the elastic means 10, as constituted preferably by a spiral or coil spring 14, to be increased, so as to favour a movement of the arm 4' in a first direction of displacement, while opposing such movement in a second, opposite direction. The first direction is the one in which the arm 4' moves away from the first connection 3.

For the user to change over from the configuration of the corkscrew illustrated in FIG. 6 to the one illustrated in FIG. 7 for the second cork drawing step, the procedure that needs to be followed is fully similar to the previously described one with reference to the second embodiment of the corkscrew according to the present invention. The elastic means 10 will in this case drive the arm 4' to displace toward the position which is allowed by the connection 21 to be the farthest one from the first connection 3 of the screw 2, as illustrated in FIG. 7. In this manner, the first abutting members 5' will be able to engage the neck of the bottle in view of completing the cork drawing procedure. It should be noticed how, owing to the kind of connection 21 used, the position of the arm 4' at the beginning of each one of the two cork drawing steps of the procedure is a reciprocal one with respect to the positions taken by the same arm 4' in the second embodiment of the present invention illustrated in FIGS. 3 to 5. The action of the elastic means 10, however, is the same in and for all embodiments of the present invention, so that the concept behind it may advantageously be used in any type of corkscrew whatsoever.

In this third embodiment of the present invention, the elastic means do not only affect the translatory movement that the arm 4' is able to perform relative to the handgrip, but also the pivoting movement of the arm relative to the same handgrip. It therefore ensues that the present invention may be embodied in such a manner as to practically enable the elastic means 10 to affect those movements of the arm 4', on which it is most appropriate and suitable to intervene in order to facilitate drawing a cork from a bottle.

Figure 8:
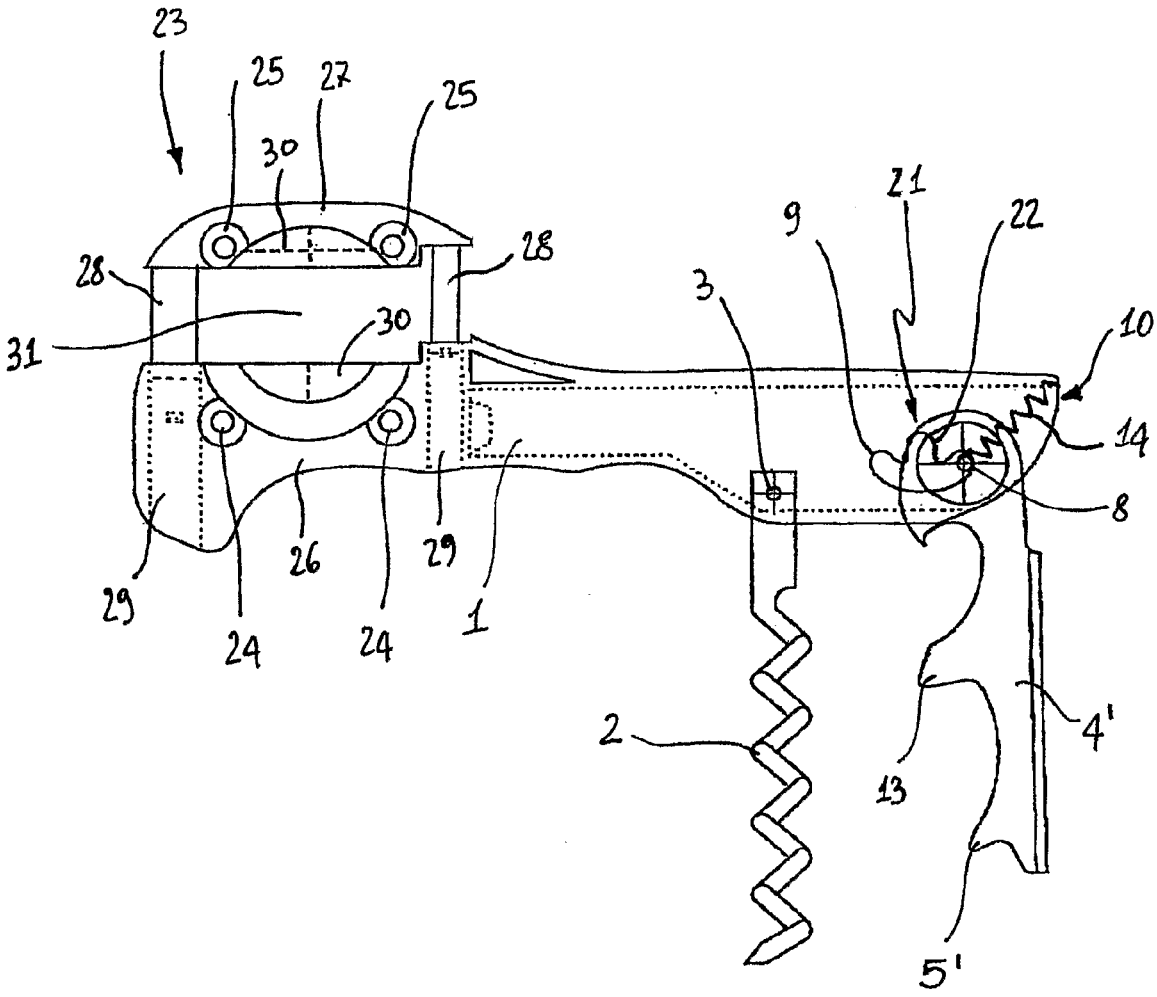
FIG. 8 is a view of a fourth embodiment of the corkscrew according to the present invention, in which there is provided a device for cutting off a film used to cover and seal the opening of the neck of the bottle.

In FIG. 8, a fourth embodiment of the present invention is illustrated, wherein the arm 4' is of the same type as the arms already illustrated in connection with both the second and the third afore-considered embodiments, i.e. comprising first and second abutting members 5' and 13 to perform a two-step procedure for pulling out a cork from a bottle. The corkscrew is provided with a screw 2 mounted on to a handgrip 1 by means of a first pivoting connection 3. The second connection 21 between the arm 4' and the handgrip 1 is made in substantially the same manner as has already been described hereinbefore in connection with the first and the second embodiments of the present invention. A stud 8, firmly joined to the arm 4', is capable of displacing in a slot 9 in which, in this particular embodiment, a notch 22 is provided and is adapted to determine a stop position for the stud 8 to come to rest in between the first and the second step of the cork drawing procedure. Elastic means 10, constituted by a spiral or coil spring 14, are provided to affect the translatory movement of the arm 4' relative to the handgrip 1 in view of facilitating the drawing of a cork from a bottle.

The elastic means 10 are arranged between the arm 4' and the handgrip 1 and, in particular, are accommodated in a recess or compartment provided inside the handgrip 1 so as to connect the latter with the stud 8 firmly joined to the arm 4'. Drawing the cork from the bottle occurs in a manner that is similar to the one that has already been described in connection with the second embodiment of the present invention. The elastic means 10, although constituted by a spiral or coil spring 14 in this case, are configured so as to increase their own potential energy as a result of a displacement of the arm 4' in a direction in which it moves closer to the first pivoting connection 3.

The handgrip 1, in a region thereof that is opposite to the one accommodating the connection 21 of the arm 4', comprises a cutting arrangement 23 for cutting off and removing a film that is applied to the neck of a bottle in order to seal and protect the opening in which the cork is inserted. The cutting arrangement 23 comprises a stationary portion 26 formed in the handgrip 1 and a support 27 slidably associated to the handgrip 1 by means of two guides constituted by arms 28 integral with the support 27 and capable of sliding into apertures 29 provided in the stationary portion 26. The support 26 is displaceable relative to the stationary portion 26 between a resting position, in which the support 27 is practically bearing against the portion 26 and the arms 28 are fully inserted in the corresponding apertures 29, and a second operating position, in which the support 27 is moved away from the portion 26 and the arms 28 are fully extended out of the apertures 29, as is illustrated in FIG. 8.

The cutting arrangement 23 comprises proper blades or cutters, preferably in the form of four small cutting wheels 24, 25 adapted to rotate relative to the handgrip 1 about an axis that is orthogonal to the longitudinal extension of the handgrip 1. A first pair of cutting wheels 24 is located on the stationary portion 26 of the handgrip 1, while a second pair of cutting wheels 25 is arranged on the support 27.

The support 27 and the stationary portion 26 comprise cavities 30 that are in the shape of a circumferential arc and are arranged so as to face each other, so that, when the support 27 is in its operating position (FIG. 8), they form a recess 31 of an adequate size to accommodate an end portion of the neck of a bottle. When this neck of a bottle is inserted in the recess 31, the cutting wheels 24, 25, which are arranged so as to adequately protrude into the recess 31, are able to interfere with a film applied to the bottle neck in order to seal it, thereby cutting it off so as to uncover the cork inserted in the neck and enable it to be then removed by the cork pulling out procedure.

It will of course be appreciated that the number of the cutting wheels 24, 25 and the conformation and shape of the support 27, as well as the connection thereof to the stationary portion 26 of the handgrip 1, may vary and be selected to most properly comply with particular requirements or to suit a particular application. For instance, the support 27 may be hinged on to the handgrip 1 and the cutters may be constituted by one or more wheels.

As is fully apparent from the above description, the corkscrew according the present invention is able to effectively reach the afore cited aims and advantages. What the present invention in fact provides is a corkscrew which is effective in facilitating the operations to be performed in view of taking a cork out of the neck of a bottle. The corkscrew according the present invention has a simple, easy-to-assemble structure and can be embodied according to a multiplicity of variants, all of which fully and similarly effective in reaching the aims of the present invention. In addition, the movement of the moving parts of the corkscrew, and particularly of the arm that includes the abutting members for the corkscrew to bear against the bottle, is so assisted as to make the corkscrew easier and more convenient to use and handle.

The invention claimed is:

1. A corkscrew comprising:

a handgrip;

a screw associated with said handgrip via a first connection, said first connection being a pivoting connection;

an arm having first abutting members and being associated with said handgrip via a stud-and-slot coupling which enables said arm to pivotally rotate relative to said handgrip in a first movement, said arm being further capable of performing a second movement relative to said handgrip;

an elastic member adapted to affect at least said second movement of said arm, wherein said elastic member is configured to exert a force adapted to move said arm away from said screw so as to assist an angular displacement of said handgrip in a direction in which a cork is to be extracted.

2. A corkscrew according to claim 1, in which said elastic member supports a movement of said arm in a first direction of displacement, while opposing a movement of said arm in a second direction of displacement opposite to the first direction of displacement.

3. A corkscrew according to claim 2, in which the first direction of displacement is a direction in which said arm moves away from said first connection of said screw.

4. A corkscrew according to claim 1, in which a displacement of said arm in a direction in which said arm moves closer to said first connection causes a potential energy of said elastic member to increase.

5. A corkscrew according to claim 1, in which said elastic member is arranged between said handgrip and said arm.

6. A corkscrew according to claim 1, in which said elastic member is constituted by either a coil spring or a flat spring.

7. A corkscrew according to claim 6, in which said elastic member is constituted by said flat spring, wherein said flat spring comprises at least a first surface portion in a cusp-like conformation so as to generate a variation in a speed of said second movement of said arm.

8. A corkscrew according to claim 1, in which said stud is firmly joined to said arm and said slot is provided in said handgrip.

9. A corkscrew according to claim 1, in which said stud is firmly joined to said handgrip and said slot is provided in said arm.

10. A corkscrew according to claim 1, in which said arm further comprises second abutting members arranged between said stud-and-slot coupling and said first abutting members.

11. A corkscrew according to claim 1, in which said handgrip comprises a cutting arrangement for cutting off a film used to seal off a neck of a bottle.

12. A corkscrew according to claim 11, in which said cutting arrangement comprises a stationary portion and a support, said support being displaceable relative to said stationary portion between a resting position and an operating position thereof.

13. A corkscrew according to claim 12, in which said stationary portion and said support comprise cavities arranged so as to face each other such that, when said support is in said operating position, said cavities form a recess adapted to accommodate an end portion of the neck of the bottle.

14. A corkscrew according to claim 13, in which said cutting arrangement comprises at least a cutting member in a form of a wheel.

15. A corkscrew according to claim 12, in which said cutting arrangement comprises at least a cutting member in a form of a wheel.

16. A corkscrew according to claim 11, in which said cutting arrangement comprises at least a cutting member in a form of a wheel.

* * * * *